US012565789B2

(12) United States Patent
Bizzarro

(10) Patent No.: US 12,565,789 B2
(45) Date of Patent: Mar. 3, 2026

(54) FENCE GAP CLOSER DEVICE

(71) Applicant: Jennie Bizzarro, Erie, PA (US)

(72) Inventor: Jennie Bizzarro, Erie, PA (US)

( * ) Notice: Subject to any disclaimer, the term of this patent is extended or adjusted under 35 U.S.C. 154(b) by 200 days.

(21) Appl. No.: 18/311,928

(22) Filed: May 4, 2023

(65) Prior Publication Data

US 2024/0191540 A1 Jun. 13, 2024

Related U.S. Application Data

(60) Provisional application No. 63/430,848, filed on Dec. 7, 2022.

(51) Int. Cl.
*E04H 17/16* (2006.01)
*E04H 17/06* (2006.01)

(52) U.S. Cl.
CPC ..... *E04H 17/16* (2013.01); *E04H 17/063* (2013.01)

(58) Field of Classification Search
CPC ..... E04H 17/063; E04H 17/08; E04H 17/16
See application file for complete search history.

(56) References Cited

U.S. PATENT DOCUMENTS 1,211,059 A * 1/1917 Blank ..... E04H 17/063 256/1
3,806,096 A * 4/1974 Eccleston ..... E04H 17/063 47/33
3,991,980 A * 11/1976 Blackburn ..... E04H 17/063 256/45
4,349,989 A * 9/1982 Snider, Jr. ..... E04H 17/063 47/33
4,478,391 A * 10/1984 Kovach ..... E04H 17/063 256/32
4,497,472 A * 2/1985 Johnson ..... E04H 17/063 256/32
4,831,776 A * 5/1989 Fritch ..... A01G 9/28 47/33
4,903,947 A * 2/1990 Groves ..... A01G 9/28 256/32
5,328,156 A 7/1994 Hoke
5,660,374 A * 8/1997 Dayberry ..... E04H 17/063 47/33
5,762,323 A 6/1998 Boswell
6,070,859 A 6/2000 Damon
6,561,491 B2 * 5/2003 Thompson ..... E04H 17/063 47/33
10,428,551 B1 10/2019 Bloomfield
11,293,198 B2 * 4/2022 Bloomfield ..... F21S 8/032
(Continued)

FOREIGN PATENT DOCUMENTS

CA 2845335 A1 * 9/2014 ..... A01G 9/28

*Primary Examiner* — Matthew R Mcmahon
(74) *Attorney, Agent, or Firm* — Brennan, Manna & Diamond, LLC

(57) ABSTRACT

The present invention relates to a novel fence gap blocking device. The device covers the gap between the bottom of a fence and the ground. The device blocks a gap of up to four inches and prevents small animals from entering or leaving the fenced area. The fence gap blocking device comprises a flat metal body component with a plurality of metal rungs or tines secured at a bottom edge. The device is installed in the inside of a fence by hammering it into the ground. Thus, allowing the flat metal body component to block the fence gap. Further, the device can be used for wooden, vinyl, and chain link fences.

11 Claims, 3 Drawing Sheets

(56) References Cited

U.S. PATENT DOCUMENTS

| | | | | |
|---|---|---|---|---|
| 12,326,007 | B2 * | 6/2025 | Mullin | E04H 17/063 |
| 2003/0160224 | A1 | 8/2003 | Damon | |
| 2005/0279981 | A1 | 12/2005 | Onbey | |
| 2011/0240939 | A1 * | 10/2011 | Justice | E04H 17/08<br>256/1 |
| 2013/0105754 | A1 * | 5/2013 | Filippo | E04H 17/16<br>256/59 |
| 2015/0021532 | A1 * | 1/2015 | Smith | E04H 17/05<br>256/65.01 |
| 2021/0189760 | A1 * | 6/2021 | Whitworth | A01M 29/30 |

* cited by examiner

FENCE GAP CLOSER DEVICE

CROSS-REFERENCE TO RELATED APPLICATION

The present application claims priority to, and the benefit of, U.S. Provisional Application No. 63/430,848, which was filed on Dec. 7, 2022, and is incorporated herein by reference in its entirety.

FIELD OF THE INVENTION

The present invention relates generally to the field of fence gap blocking devices. More specifically, the present invention relates to a fence gap blocking device designed to cover the small space underneath a fence. Accordingly, the present disclosure makes specific reference thereto. Nonetheless, it is to be appreciated that aspects of the present invention are also equally applicable to other like applications, devices, and methods of manufacture.

BACKGROUND

By way of background, this invention relates to improvements in fence gap blocking devices. Generally, small animals like stray cats, rabbits, opossums, skunks, etc., can easily enter a yard or garden and wreak havoc on plants. Accordingly, small gaps in these fences allow such animals to slip under the fence and cause damage to home exterior areas and ruin the aesthetic quality of a lawn or garden.

Additionally, many homes have dogs and other small pets which can escape their yard via the gaps under a fence. Further, dogs and other small animals can dig under the fence if they see a gap, which allows them to escape their yard. Thus, fence gaps allow for the unnecessary entry and exit of small animals into or out of a yard.

Accordingly, a need remains for a fence gap blocking device that covers the small space underneath a fence to prevent small animals from getting in and/or out of a yard. Further, a fence gap blocking device is necessary to maintain the aesthetic quality of a lawn or garden. The fence gap blocking device can be utilized on wooden, chain link, and vinyl fences.

Therefore, there exists a long-felt need in the art for a fence gap blocking device that provides users with a device designed to cover the small space underneath a fence. There is also a long-felt need in the art for a fence gap blocking device that features an elongated metal bar with tines that can be inserted into the ground to support the bar on the base of the fence. Further, there is a long-felt need in the art for a fence gap blocking device that functions with wooden, chain link and vinyl fences to block the gap under the fence and prevent entry and exit of small animals. Moreover, there is a long-felt need in the art for a device that offers a way to maintain the aesthetic quality of a lawn or garden while preventing any damage associated with small animals like rabbits, skunks, etc. Further, there is a long-felt need in the art for a fence gap blocking device that closes a four inch gap in a bottom of a fence. Finally, there is a long-felt need in the art for a fence gap blocking device that has an extension if fence poles are not spaced evenly apart.

The subject matter disclosed and claimed herein, in one embodiment thereof, comprises a fence gap blocking device. The device covers the gap between the bottom of a fence and the ground. The device blocks a gap of up to four inches and prevents small animals from entering or leaving the fenced area. The fence gap blocking device comprises a flat metal body component with a plurality of metal rungs or tines secured at a bottom edge. The device is installed in the inside of a fence by hammering it into the ground. Thus, allowing the flat metal body component to block the fence gap. Further, the device can be used for wooden, vinyl, and chain link fences. Further, the device can comprise a flat metal body component extension for fence posts/poles that are not spaced evenly apart.

In this manner, the fence gap blocking device of the present invention accomplishes all of the foregoing objectives and provides users with a device that covers the gap underneath a fence. The device prevents small animals from entering and exiting the yard. The device can be utilized with wooden, vinyl, and chain link fences.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a fence gap blocking device. The device covers the gap between the bottom of a fence and the ground. The device blocks a gap of up to four inches and prevents small animals from entering or leaving the fenced area. The fence gap blocking device comprises a flat metal body component with a plurality of metal rungs or tines secured at a bottom edge. The device is installed in the inside of a fence by hammering it into the ground. Thus, allowing the flat metal body component to block the fence gap.

Generally, the invention is directed to a fence gap blocking device for use with any suitable fence. Specifically, the fence can be a wooden fence, a vinyl fence, a chain link fence, etc., or any other suitable fence as is known in the art, depending on the needs and/or wants of a user. Accordingly, the device acts to cover and block the gap or small space underneath a fence or other support structure.

In one embodiment, the fence gap blocking device comprises a flat body component with a plurality of rungs or tines. The body component would be flat and rectangular in shape comprising a front face, a rear face, top and bottom opposing sides, and right and left opposing sides. The plurality of tines would be secured to a bottom side of the flat body component in a spaced-apart relationship to enable a user to secure the device into the ground.

In another embodiment, the plurality of tines would be cylindrical in shape, conical, prismatic, etc., depending on the needs and/or wants of a user. The tines would comprise opposing ends with a first end being secured to the flat body component and the second end comprising a point to allow the tine to easily be inserted into the ground.

In one embodiment, the height of the flat body component is approximately three to five inches in height, specifically approximately four inches in height to block the fence gap. In another embodiment, the flat body component can be manufactured in variable sizes depending on the needs and/or wants of a user.

If a user's fence gap is higher than the height of the flat body component, in yet another embodiment, an extension component can be utilized. The extension component is the same shape and size of the flat body component but could be manufactured in variable heights. The extension component would be secured to the top side of the flat body component via a snap fit. Specifically, the top side of the flat body component would comprise a plurality of holes to accept a plurality of pegs secured to a bottom of the extension component which would snap together during use.

In another embodiment, the top of the flat body component comprises a hinge and an extension component, such that the extension component can be hinged flush with the flat body component when not in use. Then, if a user needs the extra height, the extension component is extended up via the hinge for use.

In one embodiment, the length of the flat body component is approximately the same length as between the fence posts or poles. However, if there is uneven spacing between fence posts/poles, the flat body component can comprise an extension in length or a shortened length, depending on the needs and/or wants of a user.

In another embodiment, the flat body component comprises a telescoping length, that allows a user to extend or shorten the length, as needed. Further, in this embodiment, the flat body component is telescoping and comprises at least one telescoping segment that allows the total length of the flat body component to be extended or retracted. Each telescoping segment is hollow and has a slip lock for locking the segment at a specific length. Further, the slip lock is released by means of pressing or turning the slip lock. The at least one telescoping segment allows the flat body component to have a length from approximately three feet to six feet fully extended, allowing a user to set the flat body component to a desired length. Thus, the device is approximately three feet in length but can be adjusted to a length of approximately six feet, if needed. Any type of telescoping locks, such as a clutch lock, cam lock, spring button, snap lock, set knob, or any other suitable lock as is known in the art, can be used for securing a desired length of the telescoping segments and for securing the telescoping segments to each other during extension and retraction of the telescoping segments of the flat body component.

In one embodiment, the flat body component can be manufactured of any suitable metal, such as steel, aluminum, galvanized aluminum, etc., or a relatively rigid plastic material, such as PVC, ABS, polycarbonate, etc., or any other suitable UV-stabilized material as is known in the art. Further, the plurality of tines could also be manufactured of any suitable metal, such as steel, aluminum, galvanized aluminum, etc., or a relatively rigid plastic material, such as PVC, ABS, polycarbonate, etc., or any other suitable UV-stabilized material as is known in the art. In one embodiment, the flat body component and the plurality of tines can be manufactured of the same material. In another embodiment, the flat body component and the plurality of tines can be manufactured of different materials.

In one embodiment, the flat body component and the plurality of tines are manufactured of the same material and fabricated as a single, unitary component via molding, extrusion, vacuum-forming, etc., or any other suitable manufacturing means as is known in the art. In another embodiment, the flat body component and the plurality of tines are manufactured of different materials and fabricated into separate components that are secured together post manufacturing method. The separate components would be secured together via any suitable securing means as is known in the art, such as press-fit, adhesives, screws, etc.

In yet another embodiment, the fence gap blocking device comprises a plurality of indicia.

In yet another embodiment, a method of closing a fence gap between the bottom of a fence and the ground is disclosed. The method includes the steps of providing a fence gap blocking device comprising a flat metal body component with a plurality of metal rungs or tines secured at a bottom edge. The method also comprises positioning the device at the fence gap with the plurality of metal tines facing the ground. Further, the method comprises hammering the device into the ground, such that the plurality of metal tines are inserted into the ground. Finally, the method comprises utilizing the flat metal body component to block the fence gap and prevent exit and entry of small animals.

Numerous benefits and advantages of this invention will become apparent to those skilled in the art to which it pertains, upon reading and understanding the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
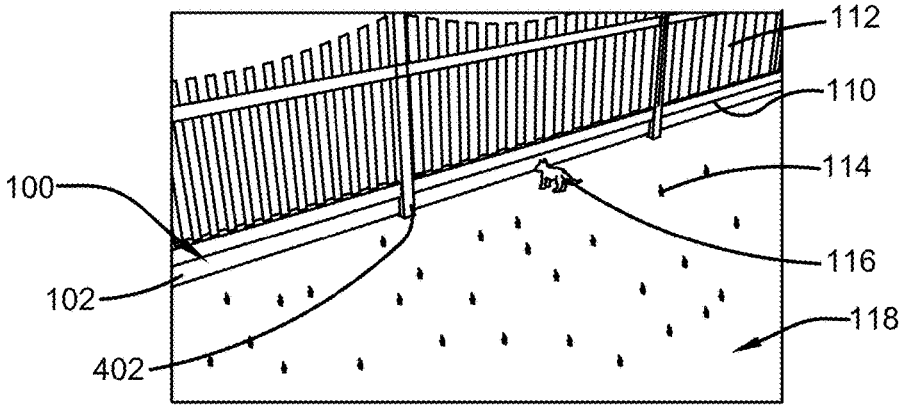
FIG. 1 illustrates a front perspective view of one embodiment of the fence gap blocking device of the present invention showing the device in use preventing small animals from exiting the yard in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a fence gap blocking device that provides users with a device designed to cover the small space underneath a fence. There is also a long-felt need in the art for a fence gap blocking device that features an elongated metal bar with tines that can be inserted into the ground to support the bar on the base of the fence. Further, there is a long-felt need in the art for a fence gap blocking device that functions with wooden, chain link, and vinyl fences to block the gap under the fence and prevent entry and exit of small animals. Moreover, there is a long-felt need in the art for a device that offers a way to maintain the aesthetic quality of a lawn or garden while preventing any damage associated with small animals like rabbits, skunks, etc. Further, there is a long-felt need in the art for a fence gap blocking device that closes a four inch gap in a bottom of a fence. Finally, there is a long-felt need in the art for a fence gap blocking device that has an extension if fence poles are not spaced evenly apart.

The present invention, in one exemplary embodiment, is a novel fence gap blocking device. The device covers the gap between the bottom of a fence and the ground. The device blocks a gap of up to four inches and prevents small animals from entering or leaving the fenced area. The fence gap blocking device comprises a flat metal body component with a plurality of metal rungs or tines secured at a bottom edge. The device is installed in the inside of a fence by hammering it into the ground. Thus, allowing the flat metal body component to block the fence gap. The present invention also includes a novel method of closing a fence gap between the bottom of a fence and the ground. The method includes the steps of providing a fence gap blocking device comprising a flat metal body component with a plurality of metal rungs or tines secured at a bottom edge. The method also comprises positioning the device at the fence gap with the plurality of metal tines facing the ground. Further, the method comprises hammering the device into the ground, such that the plurality of metal tines are inserted into the ground. Finally, the method comprises utilizing the flat metal body component to block the fence gap and prevent exit and entry of small animals.

Figure 2:
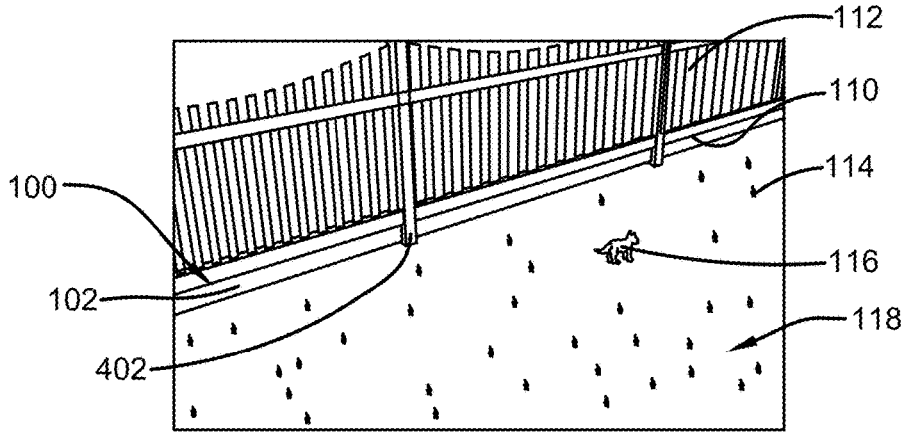
FIG. 2 illustrates a front perspective view of one embodiment of the fence gap blocking device of the present invention showing the device in use preventing small animals from entering the yard in accordance with the disclosed architecture.

Referring initially to the drawings, FIGS. 1-2 illustrate a perspective view of one embodiment of the fence gap blocking device 100 of the present invention. In the present embodiment, the fence gap blocking device 100 is an improved fence gap blocking device 100 that covers the gap 108 between the bottom 110 of a fence 112 and the ground 114. The device 100 blocks a gap 108 of up to four inches and prevents small animals 116 from entering or leaving the fenced area 118. Further, the device 100 comprises a flat metal body component 102 with a plurality of metal rungs or tines 104 secured at a bottom side 106. The device 100 is installed in the inside of a fence 112 by hammering it into the ground 114. Thus, allowing the flat metal body component 102 to block the fence gap 108.

Generally, the invention is directed to a fence gap blocking device 100 for any suitable fence 112. Specifically, the fence 112 can be a wooden fence, a vinyl fence, a chain link fence, etc., or any other suitable fence 112 as is known in the art, depending on the needs and/or wants of a user. Accordingly, the device 100 acts to cover and block the gap 108 or small space underneath a fence 112 or other support structure.

Furthermore, the fence gap blocking device 100 comprises a flat body component 102 with a plurality of rungs or tines 104. The body component 102 would be flat and rectangular in shape comprising a front face 120, a rear face 122, top 124 and bottom 106 opposing sides, and right 126 and left 128 opposing sides. The plurality of tines 104 would be secured to a bottom side 106 of the flat body component 102 in a spaced apart relationship to enable a user to secure the device 100 into the ground 114.

Generally, the plurality of tines 104 would be cylindrical in shape, conical, prismatic, etc., depending on the needs and/or wants of a user. The tines 104 would comprise opposing ends, with a first end 130 being secured to the flat body component 102 and the second end 132 comprising a point 134 to allow the tine 104 to easily be inserted into the ground 114.

Figure 3:
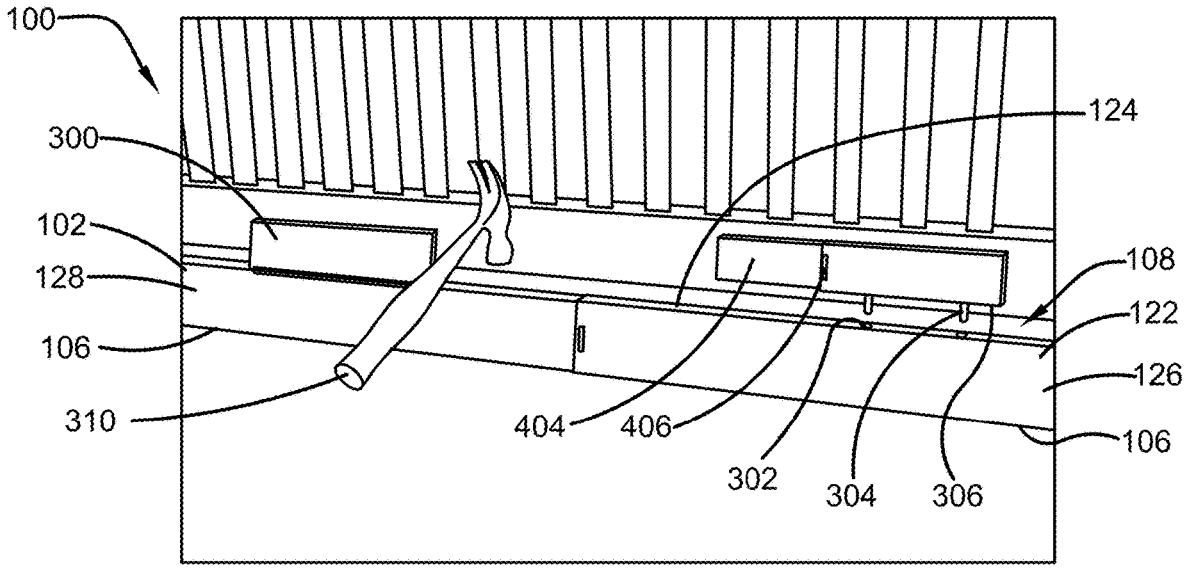
FIG. 3 illustrates a front perspective view of one embodiment of the fence gap blocking device of the present invention showing the device being installed via a hammer in accordance with the disclosed architecture.
Figure 4:
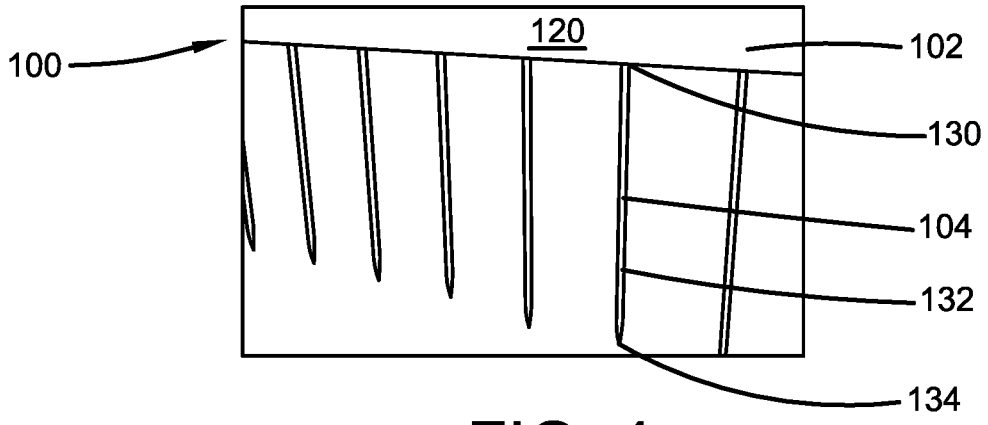
FIG. 4 illustrates a front perspective view of one embodiment of the fence gap blocking device of the present invention showing the plurality of metal tines which are inserted into the ground in accordance with the disclosed architecture.

As shown in FIG. 3, in use, the fence gap blocking device 100 is positioned to cover the gap 108 between the bottom 110 of a fence 112 and the ground 114, with the plurality of tines 104 touching the ground 114. The device 100 is installed in the inside of a fence 112 by hammering the tines 104 into the ground 114 via a hammer 310 or other suitable tool on the flat body component 102. Thus, allowing the flat metal body component 102 to block the fence gap 108. Accordingly, the device 100 blocks a gap 108 of up to four inches and prevents small animals 116 from entering or leaving the fenced area 118.

Further, the height 136 of the flat body component 102 is approximately three to five inches in height, specifically approximately four inches in height to block the fence gap 108. In one embodiment, the flat body component 102 can be manufactured in variable sizes depending on the needs and/or wants of a user.

If a user's fence gap 108 is higher than the height 136 of the flat body component 102, in yet another embodiment, an extension component 300 can be utilized. The extension component 300 is the same shape and size of the flat body component 102 but could be manufactured in variable heights. The extension component 300 would be secured to the top side 124 of the flat body component 102 via a snap fit. Specifically, the top side 124 of the flat body component 102 would comprise a plurality of holes 302 to accept a plurality of pegs 304 secured to a bottom 306 of the extension component 300, which would snap together during use.

In another embodiment, the top 124 of the flat body component 102 comprises a hinge 308 and an extension component 300, such that the extension component 300 can be hinged flush with the flat body component 102 when not in use. Then, if a user needs the extra height, the extension component 300 is extended up via the hinge for use.

As shown in FIG. 2, the length 400 of the flat body component 102 is approximately the same length as between the fence posts 402 or poles. However, if there is uneven spacing between fence posts/poles 402, the flat body component 102 can comprise an extension in length or a shortened length, depending on the needs and/or wants of a user.

In one embodiment, the flat body component 102 comprises a telescoping length, that allows a user to extend or shorten the length, as needed. Further, in this embodiment, the flat body component 102 is telescoping and comprises at least one telescoping segment 404 that allows the total length 400 of the flat body component 102 to be extended or retracted. Each telescoping segment 404 is hollow and has a slip lock 406 for locking the segment 404 at a specific length 400. Further, the slip lock 406 is released by means of pressing or turning the slip lock 406. The at least one telescoping segment 404 allows the flat body component 102 to have a length from approximately three feet to six feet fully extended, allowing a user to set the flat body component 102 to a desired length. Thus, the device 100 is approximately three feet in length but can be adjusted to a length of approximately six feet, if needed. Any type of telescoping locks 406, such as a clutch lock, cam lock, spring button, snap lock, set knob, or any other suitable lock as is known in the art, can be used for securing a desired length of the telescoping segments 404 and for securing the telescoping segments 404 to each other during extension and retraction of the telescoping segments 404 of the flat body component 102.

Figure 5:
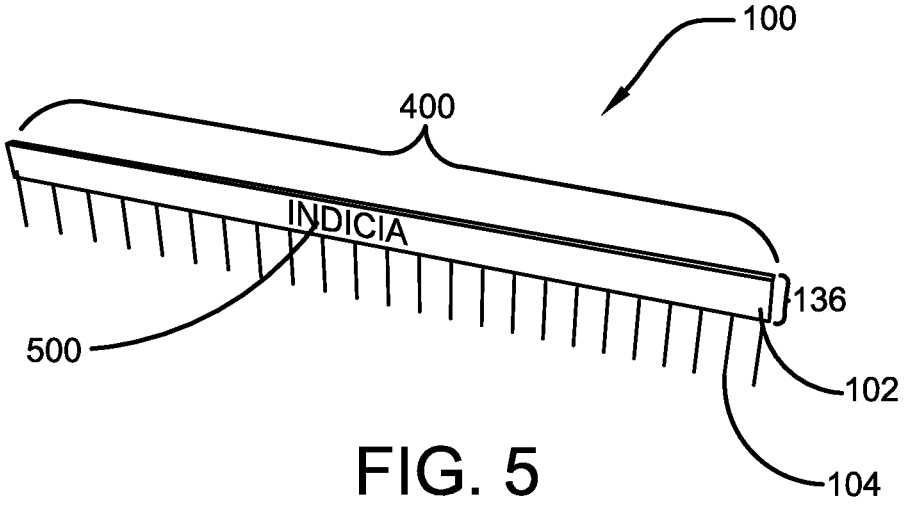
FIG. 5 illustrates a front perspective view of one embodiment of the fence gap blocking device of the present invention in accordance with the disclosed architecture.

As shown in FIG. 5, the flat body component 102 can be manufactured of any suitable metal, such as steel, aluminum, galvanized aluminum, etc., or a relatively rigid plastic material, such as PVC, ABS, polycarbonate, etc., or any other suitable UV-stabilized material as is known in the art. Further, the plurality of tines 104 could also be manufactured of any suitable metal, such as steel, aluminum, galvanized aluminum, etc., or a relatively rigid plastic material, such as PVC, ABS, polycarbonate, etc., or any other suitable UV-stabilized material as is known in the art. In one embodiment, the flat body component 102 and the plurality of tines 104 can be manufactured of the same material. In another embodiment, the flat body component 102 and the plurality of tines 104 can be manufactured of different materials.

In another embodiment, the flat body component 102 and the plurality of tines 104 are manufactured of the same material and fabricated as a single, unitary component via molding, extrusion, vacuum-forming, etc., or any other suitable manufacturing means as is known in the art. In another embodiment, the flat body component 102 and the plurality of tines 104 are manufactured of different materials and fabricated into separate components that are secured together post primarily manufacturing method. The separate components would be secured together via any suitable securing means as is known in the art, such as press-fit, adhesives, screws, etc.

In yet another embodiment, the fence gap blocking device 100 comprises a plurality of indicia 500. The flat body component 102 of the device 100 may include advertising, trademark, other letters, designs, or characters, printed, painted, stamped, or integrated into the flat body component 102, or any other indicia 500 as is known in the art. Specifically, any suitable indicia 500 as is known in the art can be included, such as, but not limited to, patterns, logos, emblems, images, symbols, designs, letters, words, characters, animals, advertisements, brands, etc., that may or may not be fence, yard, or brand related.

Figure 6:
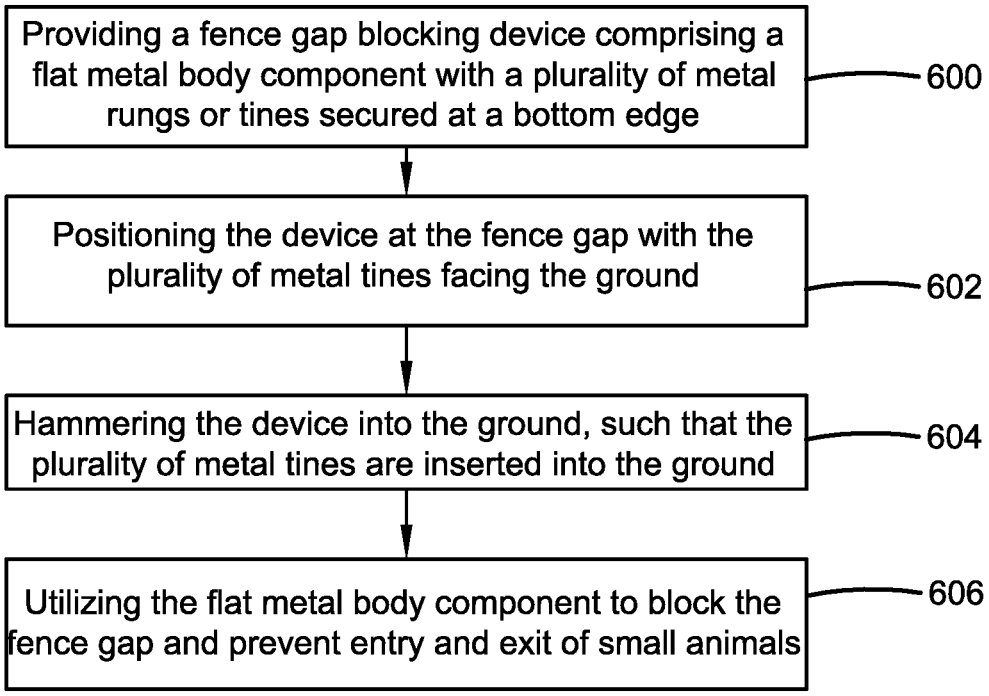
FIG. 6 illustrates a flowchart showing the method of closing a fence gap between the bottom of a fence and the ground in accordance with the disclosed architecture.

FIG. 6 illustrates a flowchart of the method of closing a fence gap between the bottom of a fence and the ground. The method includes the steps of at 600, providing a fence gap blocking device comprising a flat metal body component with a plurality of metal rungs or tines secured at a bottom edge. The method also comprises at 602, positioning the device at the fence gap with the plurality of metal tines facing the ground. Further, the method comprises at 604, hammering the device into the ground, such that the plurality of metal tines are inserted into the ground. Finally, the method comprises at 606, utilizing the flat metal body component to block the fence gap and prevent exit and entry of small animals.

Certain terms are used throughout the following description and claims to refer to particular features or components. As one skilled in the art will appreciate, different users may refer to the same feature or component by different names. This document does not intend to distinguish between components or features that differ in name but not structure or function. As used herein "fence gap blocking device", "blocking device", and "device" are interchangeable and refer to the fence gap blocking device 100 of the present invention.

Notwithstanding the foregoing, the fence gap blocking device 100 of the present invention can be of any suitable size and configuration as is known in the art without affecting the overall concept of the invention, provided that it accomplishes the above-stated objectives. One of ordinary skill in the art will appreciate that the fence gap blocking device 100 as shown in FIGS. 1-6 are for illustrative purposes only, and that many other sizes and shapes of the fence gap blocking device 100 are well within the scope of the present disclosure. Although the dimensions of the fence gap blocking device 100 are important design parameters for user convenience, the fence gap blocking device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A fence gap blocking device that covers a gap between a bottom of a fence and a ground, the fence gap blocking device comprising:

a flat body component;

a plurality of tines; and an extension component comprising a plurality of pegs extending from a bottom of the extension component; and wherein the plurality of tines are secured to the flat body component;

wherein the fence gap blocking device is installed in an inside of a fence by hammering into ground wherein the plurality of pegs of the extension component are configured to snap fit into a plurality of holes in the flat body component to secure the extension component to the flat body component.

2. The fence gap blocking device of claim 1, wherein the flat body component is rectangular in shape comprising a front face, a rear face, a top and bottom opposing sides, and right and left opposing sides.

3. The fence gap blocking device of claim 2, wherein the plurality of tines are secured to the bottom side of the flat body component in a spaced apart relationship.

4. The fence gap blocking device of claim 3, wherein the plurality of tines are cylindrical in shape with a first end secured to the flat body component and a second end comprising a point to allow the plurality of tines to easily be inserted into the ground.

5. The fence gap blocking device of claim 4, wherein the flat body component is four inches in height.

6. The fence gap blocking device of claim 5, wherein the flat body component and the plurality of tines are manufactured of different materials and fabricated into separate components that are secured together post primarily manufacturing method.

7. The fence gap blocking device of claim 6, wherein the flat body component and the plurality of tines are manufactured of a same material and fabricated as a single, unitary component.

8. A fence gap blocking device that covers a gap between a bottom of a fence and a ground, the fence gap blocking device comprising:

a flat body component which is rectangular in shape and comprises a front face, a rear face, a top and bottom opposing sides, and right and left opposing sides; and a plurality of tines that are cylindrical in shape with a first end secured to the flat body component and a second end comprising a point to allow the plurality of tines to easily be inserted into the ground;

wherein the plurality of tines are secured to the bottom side of the flat body component in a spaced apart relationship;

wherein the flat body component is four inches in height;

wherein the fence gap blocking device is installed in an inside of a fence by hammering into ground wherein the flat body component telescopes to extend and retract in length and further comprises a slip lock to temporarily fix the flat body component at a plurality of lengths.

9. The fence gap blocking device of claim 8 further comprising a plurality of indicia.

10. The fence gap blocking device of claim 8, wherein the flat body component and the plurality of tines are manufactured of different materials and fabricated into separate components that are secured together post primarily manufacturing method.

11. The fence gap blocking device of claim 8, wherein the flat body component and the plurality of tines are manufactured of a same material and fabricated as a single, unitary component.

* * * * *